United States Patent [19]

Lindén et al.

[11] 3,945,198

[45] Mar. 23, 1976

[54] CHAIN MAKING APPARATUS

[75] Inventors: Sven-Erik Lindén, Laxa; Hans Erik Otto Schalling, Hasselfors, both of Sweden

[73] Assignee: Elektriska Svetsningsaktiebolaget, Gothenburg, Sweden

[22] Filed: Oct. 22, 1974

[21] Appl. No.: 517,004

[30] Foreign Application Priority Data

Oct. 25, 1973 Sweden ..... 7314459

[52] U.S. Cl. ..... 59/16; 59/18; 59/19; 59/22; 59/29

[51] Int. Cl.[2] ..... B21L 7/00

[58] Field of Search ..... 59/16, 18, 19, 20, 22–26, 59/29, 30, 35, 8

[56] References Cited

UNITED STATES PATENTS 3,701,251 10/1972 Andreasson et al. ..... 59/16

FOREIGN PATENTS OR APPLICATIONS 1,206,703 12/1965 Germany ..... 59/22

*Primary Examiner*—C. W. Lanham
*Assistant Examiner*—Joseph A. Walkowski
*Attorney, Agent, or Firm*—Cameron, Kerkam, Sutton, Stowell & Stowell

[57] ABSTRACT

A chain making plant for the manufacture of two chains at a time by means of a series of operating stations arranged along a substantially straight course. Two conveyor units are provided, each of which successively presents a depending portion of one chain to the operating stations. Each of the conveyor units comprises a carriage running on a track extending along the course and a transverse chain conveyor supported by said carriage, said transverse chain conveyor being arranged to feed the chain outwards step by step and being capable of being shifted transversely as a unit with respect to the carriage.

1 Claim, 2 Drawing Figures

CHAIN MAKING APPARATUS

BACKGROUND OF THE INVENTION

This invention relates to apparatus for making chains, particularly large chains made from bar stock having a diameter of 30 mm or more. More particularly, the invention relates to a plant for manufacturing two chains at a time comprising a pair of substantially parallel tracks arranged one at each side of a central space or course, a first carriage running on one of said tracks for moving a depending end portion of one chain previously formed along said course to be presented successively to a plurality of operating stations provided in said course for performing a succession of operations including inserting a heated piece of bar into the lowest link of said depending portion, bending said piece of bar to form a link, flash butt welding the joint of said link and trimming the joint to remove the welding burr or bulge, and a second carriage running on the other track for moving a depending portion of the other chain along said course to be presented to said operating stations.

In a published design for a plant of this general type, each of the carriages is provided with a single chain wheel for carrying the chain. The space separating the tracks is amply sufficient to ensure that the carriages, with their chain wheels and the chain carried by them, can be shifted along their respective tracks without interfering with each other. As the chain end, when hanging straight down from the chain wheel of the carriage, is out of alignment with the operating stations, the operator has to pull the depending chain end sidewards to cause the lowermost link to be presented to the operating machine in the proper position to be gripped by the clamping means of the operating machine. This is a laborious and awkward operation which, while still possible for chains made of, say, 30 mm bar stock, becomes increasingly difficult or impossible for still larger chains, such as the very large chains frequently required as mooring chains for large tankers, oil boring platforms etc. Such chains are made from 50 mm diameter or still heavier bar stock, and the weight of one link may amount to 500 kgs.

SUMMARY OF THE INVENTION

The invention provides, in a chain making plant of the general type above specified, the improvement comprising a transverse frame movably supported by each of said carriages, and conveyor means supported by each of said transverse frames for advancing the chain outwards from said course in the transverse direction, said conveyor means including a take-up member supporting the depending portion of the chain, each of said transverse frames being displaceable transversely to adjust the transverse position of said take-up member within a range allowing proper positioning of the vertically depending chain portion with respect to the operating stations and also allowing adjustment of the take-up members to a transverse position with respect to each other in which there is a transverse clearance between said take-up members permitting of unobstructed shifting of one carriage past the other carriage.

Other features and advantages of the invention will appear from the following description and from the accompanying drawings representing somewhat schematically a preferred embodiment of the invention.

DESCRIPTION OF THE PREFERRED EMBODIMENT

Figure 1:
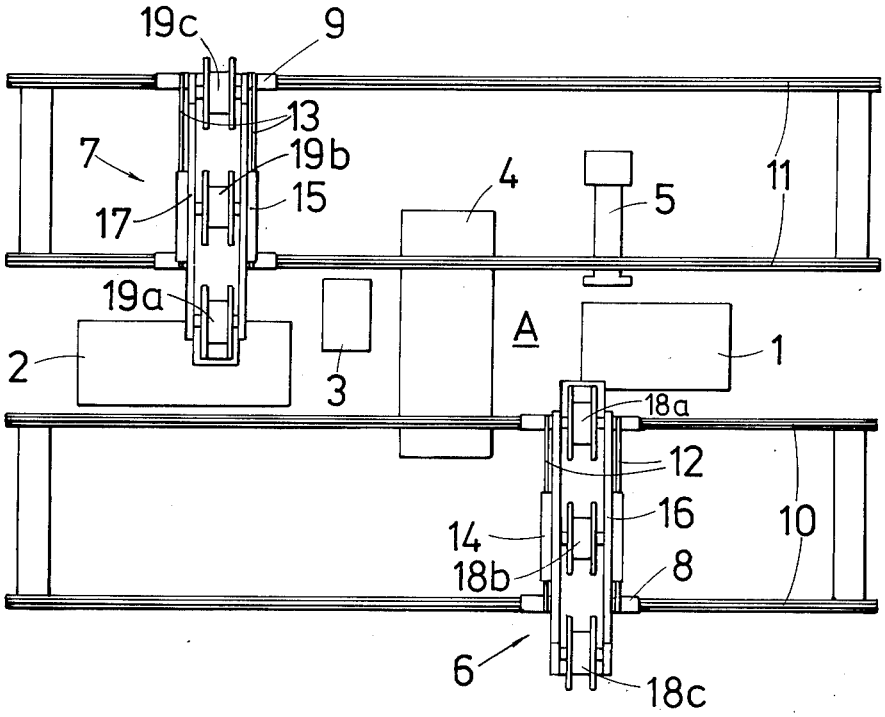
FIG. 1 is a plan view of a chain making plant.

Referring first to FIG. 1, a group of operating machines 1 to 4 is arranged along an aisle or course A on a shop floor. Said group comprises a bending machine 1, a flash welding machine 2, a trimming machine 3 and a stud press 4. All of said machines are represented schematically only and do not have to be described, as such machines are well known to those skilled in the chain making art. A piece of bar cut to the proper length to form a link is heated in a heater 5 placed beside the bending machine 1, inserted into the last link of a chain and bent to form a C-shaped link. Said link, as well as the end of the chain to which it is attached, is then shifted to the welding machine 2, in which the flash welding of the joint is performed. The welding burr is removed in the trimming machine 3. Finally, the link is provided with a stud in the stud press 4.

To utilize the capacity of the machines as well as possible, two chains (K1 and K2, FIG. 2) at a time are manufactured in the plant. A pair of conveyor units 6, 7 serve to support the ends of the chains and to shift them as required between the operating machines. Each of the conveyor units comprises a carriage 8, 9, respectively, running on a pair of parallel rails 10, 11, respectively, extending along the course A. Each of the carriages 8, 9 is provided with a pair of transverse rails 12, 13, respectively, for a trolley 14, 15, respectively, supporting a transverse conveyor frame 16, 17, respectively, equipped with three chain wheels 18*a*, 18*b*, 18*c*, and 19*a*, 19*b*, 19*c*, respectively, supporting the chain K1, K2, respectively. At least one of the three chain wheels 18*a*, 18*b*, 18*c*, and 19*a*, 19*b*, 19*c*, of each of the conveyors is provided with a suitable power drive (not shown) for advancing the chain step by step in the direction away from the course A towards a receiving site 20, 21, respectively. The ends of the chains to which additional links are to be added depend freely from the innermost chain wheels 18*a*, 19*a* through drums 22, 23, each of which is rotatable about its vertical axis and provided at its lower end with a cruciform guide slot by means of which the chain can be rotated through 90° to put the bottom link into the proper position with respect to the operating machine.

Figure 2:
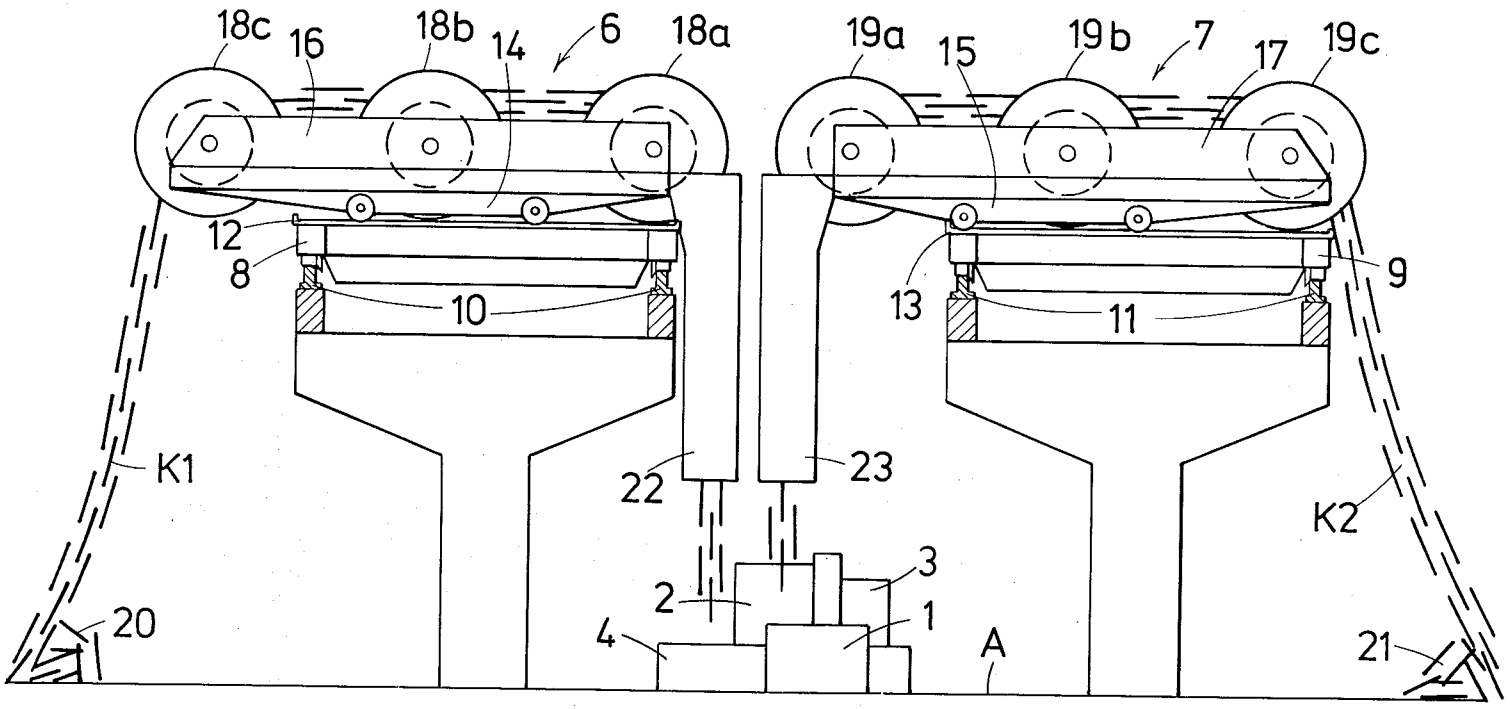
FIG. 2 is a side view of the plant on a larger scale.

FIGS. 1 and 2 represent the plant in a situation in which one conveyor unit 6 has just been moved away from the bending machine 1 and is on its way towards the flash butt welding machine 2, while the other conveyor unit 7 has just left the flash butt welding machine 2 to be shifted to the trimming machine 3. To make the conveyor unit 6 go clear of the conveyor unit 7 when the units are moved past each other, the trolley 14 of the unit 6 is shifted back into the withdrawn position represented in FIG. 2. As soon as the conveyor unit 6 has reached the longitudinal position required for the welding operation, the trolley 14 and the transverse conveyor 16 carried by said trolley are shifted back into the operative position to place the link to be welded within the reach of the chuck or clamping mechanism of the welding machine 2.

While welding of the last link of the chain K1 is in progress, the bottom link of the other chain K2 supported by the conveyor unit 7 is trimmed, shifted to the stud press 4, fitted with a stud, and shifted to the bending machine, in which a fresh link is added. Prior to the addition of the fresh link in the bending machine, the depending chain end has to be raised a distance equal to the pitch of the chain. Said raising operation is performed by advancing the chain by means of the power driven chain wheel or wheels of the transverse conveyor 17.

When the link closing operation has been performed in the bending machine, the trolley 15 of the conveyor unit 7 and the transverse conveyor 17 carried by said trolley are shifted rearwards into the withdrawn position to provide the clearance required to allow the conveyor unit 7 to move past the conveyor unit 6 which is not to be shifted to the trimming machine 3.

The movability of the transverse conveyor frames 16 and 17 provided by the trolleys 14, 15 can, of course, also be employed to effect the transversal adjustment of the position of the depending chain ends which may be necessary to get the bottom link into the proper position with reference to the chuck or clamping mechanism of the operating machine to which the link is to be presented.

In the embodiment described, the transverse conveyor frames are supported for translatory transverse motion with respect to their respective carriages. It is equally possible to support the transverse conveyor frames for angular motion in a transverse plane, for instance angular motion about the axis of the outer, or rear, chain wheel of the transverse conveyor. In this respect as well as in other respects, the invention is not limited to the embodiment shown in the drawings but comprises any arrangement within the scope of the following claims.

We claim:

1. In a plant for the manufacture of two chains at a time comprising a pair of substantially parallel tracks at either side of a course, a first carriage running on one of said tracks for moving a depending end portion of one chain previously formed along said course to be presented successively to a plurality of operating stations provided in said course for performing a succession of operations including inserting a heated piece of bar into the lowest link of said depending portion and bending said piece of bar to form a link, flash butt welding the joint of said link and trimming the joint to remove the welding burr or bulge, and a second carriage running on the other track for moving a depending end portion of the other chain along said course to be presented to said operating stations, the improvement comprising a transverse frame movably supported by each of said carriages, and conveyor means supported by each of said transverse frames for advancing the chain outwards from said course in the transverse direction, said conveyor means including a take-up member supporting the depending portion of the chain, each of said transverse frames being displaceable transversely to adjust the transverse position of said take-up member within a range allowing proper positioning of the vertically depending chain portion with respect to the operating stations and also allowing adjustment of the take-up members to a transverse position with respect to each other in which there is a transverse clearance between said take-up members permitting of unobstructed shifting of one carriage past the other carriage.

* * * * *